US005269511A

United States Patent [19]

Chavez

[11] Patent Number: 5,269,511

[45] Date of Patent: Dec. 14, 1993

[54] BASEBALL BATTING TRAINING AID

[76] Inventor: David M. Chavez, 2700 Panorama Dr., #410, Signal Hill, Calif. 90806

[21] Appl. No.: 583,664

[22] Filed: Sep. 11, 1990

Related U.S. Application Data

[63] Continuation of Ser. No. 809,141, Dec. 16, 1989, abandoned.

[51] Int. Cl.[5] ..... A63B 69/40

[52] U.S. Cl. ..... 273/26 R; 273/29 A

[58] Field of Search ..... 273/26 R, 29 A, 26 b, 273/67 R, 88, 326, 73 G, 73 A, 80 C, 73 J, 80 B, 80 A, 72 R, 75, 81 R, 81 D, 81.3

[56] References Cited

U.S. PATENT DOCUMENTS

| | | | |
|---|---|---|---|
| 1,877,820 | 9/1932 | Costello | 273/26 B |
| 3,206,195 | 9/1965 | Meyers | 273/26 R |
| 3,264,894 | 4/1966 | Salsburry | 273/26 B |
| 3,268,226 | 8/1966 | Martino | 273/26 B |
| 4,174,348 | 4/1979 | Lee | 273/75 |
| 4,221,383 | 9/1980 | Cappelli | 273/73 C |
| 4,240,636 | 12/1980 | Swenson | 273/80 C |
| 4,511,147 | 4/1985 | Olsen | 273/80 C |
| 4,625,965 | 12/1986 | Mullins | 273/80 C |
| 4,659,080 | 4/1987 | Stoller | 273/75 |

OTHER PUBLICATIONS

Washington Star-News (Sports) p. D1, Jan. 17, 1974.

*Primary Examiner*—Theatrice Brown

*Attorney, Agent, or Firm*—Keith D. Beecher

[57] ABSTRACT

A baseball training aid for use by a batter to improve his swing. The training aid comprises a frame defining a rectangular loop, and an elongated handle attached to the loop and extending outwardly therefrom. A net is secured to the loop. The handle is angled at a point adjacent to the frame so that the plane of the frame is at an angle to the intermediate portion of the handle. The handle has a grip on its remote end, and the handle is also angled at that end so that a first portion of the grip at the extremity of the handle extends at an angle to a second adjacent portion of the grip and to the intermediate portion of the handle, so that the plane of the frame is displaced from the angled extremity of the handle. The batter grasps the first portion of the grip with one hand which extends over the corresponding angle, and grasps the second portion of the grip with his other hand 5 Claims, 2 Drawing Sheets 10
12
14
16
18
20
26
W
11°

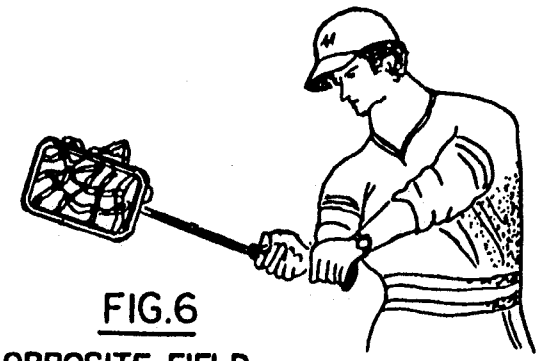
FIG. 6
OPPOSITE FIELD
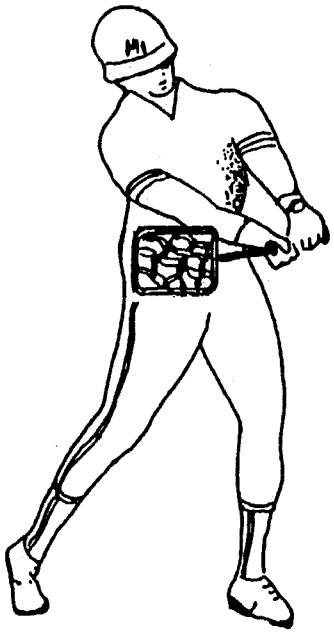
FIG. 7
CORRECT SWING
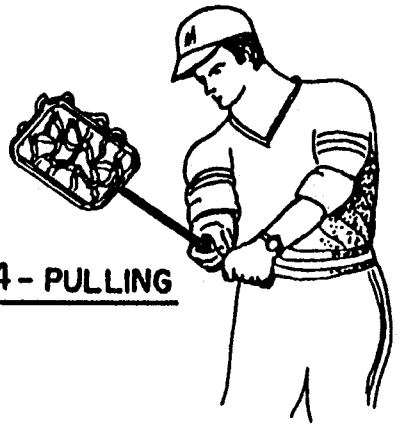
FIG. 4 - PULLING
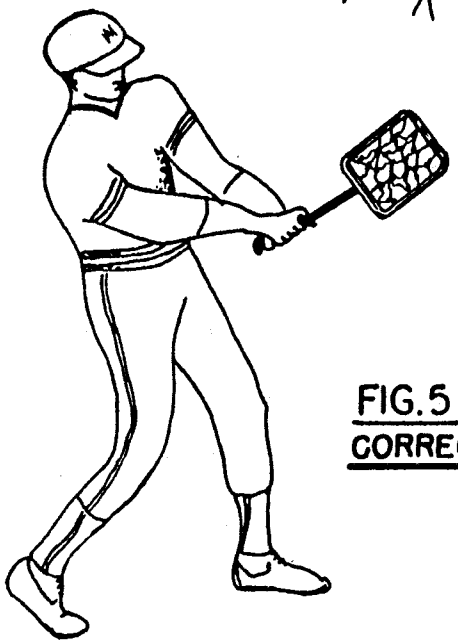
FIG. 5
CORRECT SWING

BASEBALL BATTING TRAINING AID

This application is a continuation of Copending application Ser. No. 809,141 filed Dec. 16, 1985 (abandoned).

BACKGROUND OF THE INVENTION

The baseball batting training aid of the present invention is of the same general type as described in U.S. Pat. No. 3,206,195. As stated in that patent, a problem in teaching batting in baseball is that the player can neither view his own performance, nor feel to any appreciable extent the difference between a proper and improper swing. Virtually the only criteria the batter has to judge his performance is by observing the end results. This leads to difficulties, because the player often continues to practice bad habits, making them progressively more difficult to correct.

In order for a batter to be a good hitter he must train his hands to use the bat barrel properly. The bat barrel controls where and how hard the ball is to be hit. If a batter does not use his hands correctly he cannot become a good hitter. The batter's hands control the bat barrel in basically three (3) different ways. First they create bat speed. That means that the faster the batter can get the bat from his stance to contact with the ball, the greater the leverage and power he will have. To do this batter must move from the inside out position where his bottom hand (hand closest to knob or end of bat) is in a position where the back of the hand is facing up or towards the sky and his top hand (hand closest to the bat barrel) is in a position where the palm is facing up or towards the sky, to a position where the back of the bottom hand and the palm of the top hand are facing in the direction the ball is being hit. This action of the hands "throws" the barrel of the bat out in front of the body creating bat speed. The quicker this can be done the better chance the batter has of making good contact with the ball.

Second, the hands control where contact is made with the ball. When the hands work together they thrust the bat barrel in front of the body and towards the pitcher, putting it (the bat barrel) in a good leverage position to get maximum power and leverage when the ball is hit.

Third, the batter must time his swing so that contact is made when the pitched ball enters the good contact zone. To do this a great deal of skill is necessary to control the bat barrel until the exact moment the ball gets into batter's good hitting zone. If batters swings the bat before ball reaches the contact zone the bat barrel will be ahead of the ball and poor or no contact will be made. This is called "rolling the wrist". If batter swings too late or after the ball passes the contact area he will not get his bat barrel out in front and will not have any leverage or bat speed working. This called a "jam". Pitchers work very hard in order to keep batters off balance, and batters must spend a great deal of time perfecting their timing.

The batting training aid disclosed in U.S. Pat. No. 3,206,195 represents a vehicle for enabling batters to practice their swings, so that their hands are in the proper position at point of contact with the ball. But, it was found that to use this earlier training aid the batter would have to know how to swing the bat in order to get any benefit from the training aid. If batter did not know how to swing a bat he could swing the prior art training aid incorrectly and still catch the ball. This, of course, allowed him to practice poor fundamentals and not only not improve his hitting, but to progressively get worse by reinforcing bad techniques. So while this previous training aid was better than anything else on the market at that time, it left a lot to be desired.

The batting training aid of the present invention constitutes a vast improvement over the training aid described in U.S. Pat. No. 3,206,195 in that the handle of the training aid of the present invention is shaped to define an angle to its remote end, so that the training aid must be gripped by the batter with the palm of the bottom hand extending over the angle and with the top hand on the intermediate portion of the handle. This causes the hands of the batter to be angled with respect to one another so that the training aid is grasped along the fingers giving maximum flexibility in the wrists, instead of being gripped on the palms of the hands where the tendency is to lock the wrists. This allows the batter to create maximum bat speed. This angle puts the top hand ahead of the bottom hand at the point of contact forcing the batter to swing through the ball. However, of the approach or inside out position the top hand is slightly below the bottom hand. This forces the batter to exaggerate the action of the top hand in "throwing" the bat barrel. (Top hand controls the bat barrel). By getting the feeling of the action of the top hand, the batter learns how to control the bat barrel. The action of the top hand is a very important technique which is necessary in becoming a good hitter.

A second angle is formed in the end of the handle of the batting aid of the present invention adjacent to the frame to displace the axis of the angled extremity of the handle from the plane of the frame. This puts the opening portion of the frame (corresponding to the bat barrel) in a straight line with the bottom hand as would be a bat barrel. This is very important when working on the timing aspect of the swing. If the net opening was offset, timing would not be similar to a baseball bat and instead of batter improving his timing it would impede his timing.

BRIEF DESCRIPTION OF THE DRAWINGS

FIGS. 4, 5, 6 and 7 are illustrations showing the manner in which the training aid of the invention is actually used.

DETAILED DESCRIPTION OF THE ILLUSTRATED EMBODIMENT

Figures 1, 2, 3:
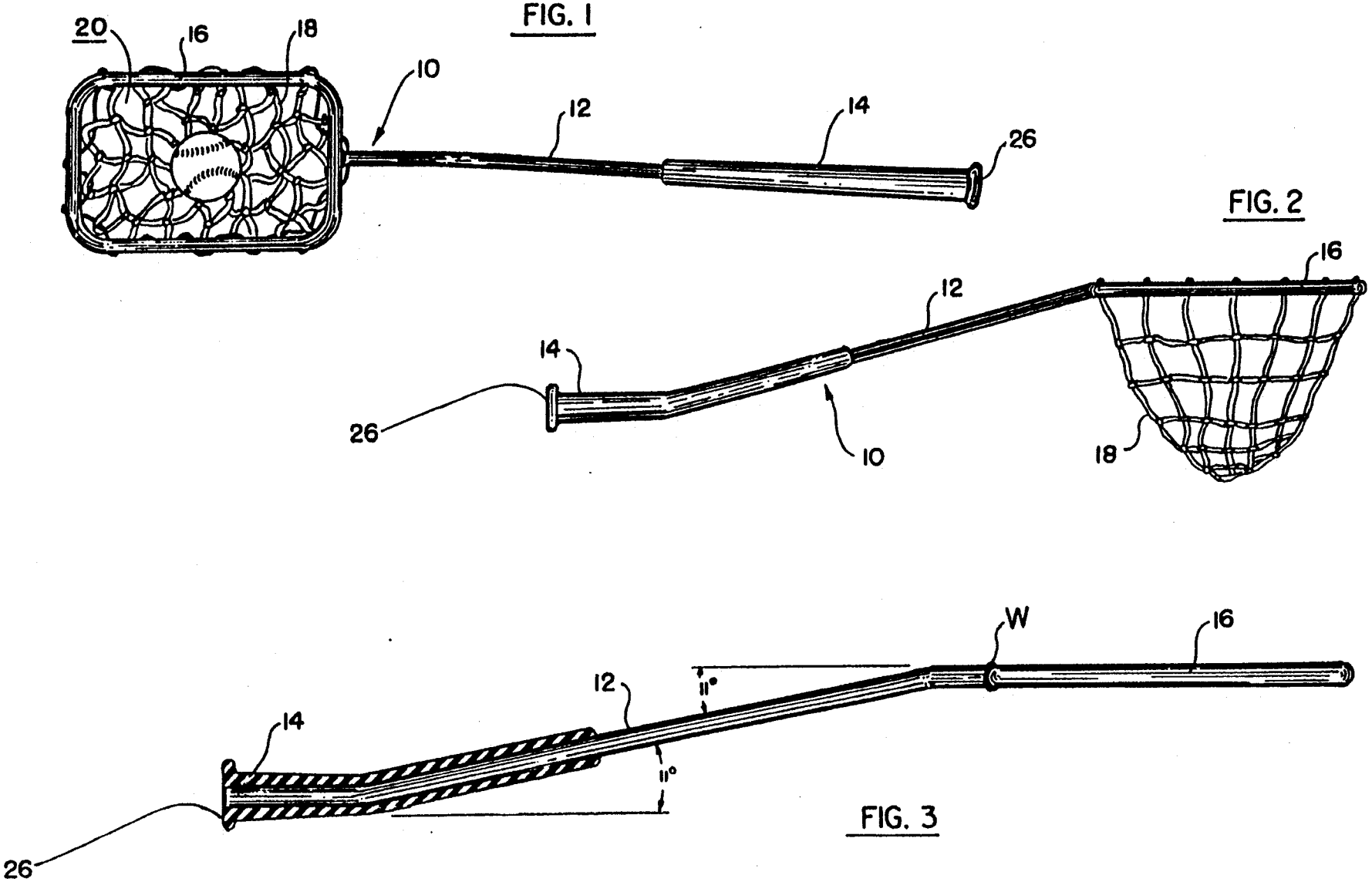
FIG. 1 is a front view of the batting aid of the present invention in one of its embodiments.
FIG. 2 is a side view of the batting aid of FIG. 1.
FIG. 3 is a view of the batting aid, like FIG. 2, showing schematically various features of the batting aid.

Referring now to FIGS. 1, 2 and 3 the batting aid of the invention is indicated generally by reference number 10. The batting aid 10 includes a handle 12 having a grip 14 at its proximal end and a frame 16 at its distal end, with a net 18 secured to the frame. The handle 12 is preferably made of a material which is strong and durable, as for example steel. For example, the handle and frame may be made of three quarter inch galvanized steel tubing, which may be either zinc or cadmium plated. Likewise, grip 14 is formed of a material that may be comfortably gripped for a long period of time and which is likewise strong and durable. Certain plastics, as well as natural rubber have been found particularly advantageous for forming the handle. The net 18 may be suitably formed of a variety of different materials although high strength nylon cord is presently preferred.

The handle 12 is an elongated member of tubular cross-section. The frame 16 is mounted at one end of handle 12. As shown, frame 16 comprises a flat continuous hoop formed of a member of a cross-section similar to that of handle 12 and shaped to define the perimeter of a generally rectangular opening 20.

It is desirable that the batting aid 10 accurately simulate the conditions encountered when batting with a normal ball. To this end, the weight and balance of the batting aid are such that, when swung, it feels to the batters substantially like a normal bat.

The width of the opening 20 measured in the direction perpendicular to the axis of the handle and frame is at least equal to the diameter of a baseball and the diameter of the barrel of a bat, side-by-side, in order that it can freely receive the ball to simulate contact with the bat. Preferably, the overall length of the aid is made essentially equal to that of a normal baseball bat, with the length of opening 20 corresponding to that portion of the bat barrel with which it is desired to contact the ball.

The net 18 is secured to the frame 16 around the perimeter of opening 20, and it is arranged to catch balls passing through the opening. To cushion the shock of the ball striking the net 18, the net is made flexible. As noted above, nylon cord has been found to be particularly advantageous. The net may, of course, be any suitable design provided, of course, that the mesh size is smaller than the diameter of the ball. A further advantage of the flexible net arrangement is that the net 18 may be positioned initially on either side of the frame to net balls passing through the opening from either side. This serves to render the aid capable of being used after being turned around 180. The latter use is the same except that now the bend in the bottom hand is back instead of forward. This is especially helpful when the batter is having trouble pulling the ball.

The grip 14 is secured to the end of the handle. This is achieved in the illustrated embodiment by providing the grip 14 with a cylindrical bore which telescopically receives the end of handle 12 in a tight fitting engagement. Preferably, grip 14 is generally cylindrical in external shape to simulate the handle of a baseball bat. To prevent the batter's bottom had from sliding off the end of the handle, a radially enlarged knob is formed on the end of grip 14 which, likewise, simulates the knob at the end of a baseball bat.

In accordance with the concepts of the present invention, and is best shown in the schematic view of FIG. 3, the angle in handle 12 covered by grip 14 for example, may be 11°, and is position at approximately three (3) inches from knob 26 on the end of grip 14. A second angle, which likewise may be 11°, is formed in the handle adjacent to the frame 16. Grip 14, for example, is approximately 8 inches long. This places the first angle or bend in the center of the bottom hand, i.e., the left hand of a right handed batter. As shown in FIG. 3, frame 16 is wielded to the opposite end of the handle, for example, by a wield W.

In hitting with a regular baseball bat, and with the batting aid of the invention, the bottom hand is the hand closest to the knob 26, and the top hand is displaced along the grip and is responsible for "throwing" the barrel of the bat at the ball. When the swing is proper, the ball will be cleaningly hit by a regular baseball bat, and will be caught in the net of the batting aid of the invention, with the palm of the top hand and opening 20 facing in the same direction. However, if the batter rolls his wrists or jams himself, he will not be able to catch the ball in the net, because the opening will be facing the ground. The handle of the batting aid is angled in the particular manner described above to assist the batter in gripping the handle in the proper way to achieve the proper swing so as to catch the ball in the net, and when translated to a regular baseball bat to hit the ball cleanly.

With the batter's hands properly positioned on grip 14, the batting aid 10 is then swung at the ball which may be pitched in the usual manner. Proper positioning of the hands occurs when the batter grasps the angled end portion of the grip with the bottom hand, and grasps the adjacent portion of the grip with the top hand, so that the hands of the batter are angled with respect to one another. Specifically, the bottom hand grips the handle in the middle of the bend, so that the rear portion of the hand is bent with respect to the forward portion. This causes the batter to grip the handle with his fingers instead of with the palm of the hand, this being essential in gripping a regular baseball bat for proper power hitting action. In using the batting aid of the invention, the forward portion of the bottom hand is turned down on the intermediate portion of the grip and is angled to be in essential alignment with frame 16. The top hand is positioned on the intermediate portion of the handle and, together, the hands are automatically placed in the proper positions for grasping a regular baseball bat so that when the bat is swung the barrel is actually "thrown" at the ball which generates greater bat speed for an effective power stroke.

Assuming that the swing is proper, the ball will pass through the opening 20 to be caught in net 18. Since net 18 is flexible, it serves to cushion the shock. Furthermore, once the ball is caught in the net, the training aid takes on an added weight at its outer end, and this actually works to advantage by forcing the batter to following through in his swing.

Assuming now that the player swings improperly, for example, by rolling the wrists beyond the desired extend causing the back side of the bottom hand to face the ground. In this condition, the vertical extend of the opening 20 is greatly reduced at the instant the ball would normally pass through it. Accordingly, the ball is missed, or strikes the frame.

Similarly, should the player fail to roll his wrists soon enough, the opening 20 will be tilted upwardly, and again preventing the training aid from catching the ball in its net. With a normal round baseball bat the batter can pull the ball to one field or hit the ball to the opposite field and does not have to change the position of his hands gripping the bat. Yet, he is making contact on a different surface. Again, when he pulls the ball, he makes contact with the surface facing in the same direction as the back of his bottom hand. When hitting to the opposite field, contact is made with the back of the bottom hand and with the palm of the top hand facing up. With every turn of the hands the batting surface of the bat changes.

With the training aid being flat, however, the grip is important because it controls the position of the net opening. To practice pulling the ball, the net opening must be in position in front of the hands to catch the ball, facing in the same direction as the palm of the top and the back of the bottom hand (FIG. 4). If the batter were wearing a wristwatch on his bottom hand the face of the watch and the net opening are both facing in the same direction. To practice hitting to the opposite field, the training aid must be turned so that the net opening is in position behind the hands to catch the ball. The net opening must now be facing in the same direction as the fist of the bottom hand (FIG. 6). Again, if the batter had a wristwatch on with the net in the position to catch the ball, the face of the wristwatch would now be directed toward the sky.

Specifically, in order to practice pulling a baseball the baseball must be caught in front of the hands. To catch the ball in front of the hands, the batter must grip the batting aid so that the net opening is in the same direction as the back of the front hand, but with the handle turned so that the plane of the frame defines the entrance to the net in front of the hands, as shown in FIG. 4. To pull properly, the batter must use his hands, wrists and forearms to position the net in the open position out in front of the body, as shown in FIG. 5.

In order to practice hitting the ball to the opposite field, the ball must be caught behind the hands. In order to catch the ball behind the hands, the batter must reverse the training aid from the position shown in FIG. 4 to the position shown in FIG. 6 so that the plane of the net opening is behind the hands, and all balls must be caught behind the hands. The proper way to hit to the opposite field is with the hands held out in front, as shown in FIG. 7, which puts the net in its proper position to catch the ball.

To practice hitting the ball to center field, the training aid should be turned to a position between the positions of FIGS. 4 and 6.

It will be understood, therefor, that for batting practice, the training aid of the invention is used as one would use a regular baseball bat, with the batter concentrating on swinging through the ball. If the swing in any particular instance is correct, the ball will be caught in the net. If the swing is incorrect, the ball is will not be caught. The training aid may be used to practice pulling the ball to one field, or hitting the ball to the opposite field, or hitting the ball to center field, as described above. The training aid of the invention, moreover, may be used on all pitches, for example, fast ball, curve ball, and other off-speed pitches, high and low pitches The bend in the handle created by the angled grip of the training aid of the invention is important in enabling the batter to feel the correct use of the hands in order to generate bat speed. As noted above, the angled grip forces the batter to hold the handle with the fingers rather than with the palms of the hands; and it places the hands in positions where at the point of contact with the ball, so that the top hand is slightly ahead of the bottom hand, and yet, from the inside out position the top hand is actually below the bottom hand. The batter must exaggerate the action of the top hand to get the training aid in position to catch the ball. By putting the emphasis on the use of the top hand with the training aid, the batter can transfer this action to the regular bat.

To reiterate, in order to be a good hitter, three factors are important to a batter. These factors, are bat speed, contact zone and timing. The batter must make contact in front of his body at the optimum leverage position. Also, the batter must wait until the ball is in the contact position if the bat is to strike the ball with the proper contact. Specifically, the batter must not swing too early or too late. Accordingly, bat speed, proper contact zone and timing are all important factors in hitting the ball. The training aid of the invention is specifically constructed to enable a batter to master the three factors set forth above.

The angled configuration of the handle, as explained above, causes the batter to grip the handle in the fingers, rather than by the palm, and this provides the proper hand position to throw the bat barrel at the ball so as to create bat speed, and to place the bat in front of the body in the correct contact zone so as to make proper contact with the ball. Also, the hands control the position of the opening of the training aid, and since the opening is in an open position to catch the ball for a very short time, the aid is an excellent means for training the batter to acquire proper timing.

The training aid of the invention was developed particularly to help the batter's techniques. The rectangle or opening of the net of the training aid corresponds to the barrel of the bat. The bend in the handle of the training aid adjacent to the knob is the most important part of the training aid in order to train. The batter so that his hands carry the bat barrel to the ball in the most efficient manner. This bend in the handle fits right in the middle of the bottom hand of the batter, so that when the batter grips the training aid, it must be gripped by the fingers. Likewise, for the upper hand, the batter has to grip the handle with the fingers instead of the palm. These factors provide the user flexibility and enables him to throw the barrel of the bat to the contact zone with the hands properly positioned on the handle. In general, the training aid trains the hands to use the bat barrel at just the right time and it forces the batter to do everything out in front which is the best leverage position.

It is important to understand that when the training aid is gripped in the described manner, the opening of the net is not offset from the gripping axis. In other words, the opening of the training aid is in the same position that the normal bat barrel would be. If the net of the training aid were offset when the handle was gripped by the lower hand, then it could not improve timing because it would not simulate a baseball bat. It is important to understand that while there is a second bend in the handle of the training aid adjacent to the net, the plane of the net is not offset from the gripping axis of the aid, since if it were offset the unit would not simulate a baseball bat and it would be ineffective as a training aid.

It should be pointed out that while a particular embodiment of the invention has been shown and described, modifications may be made. It is intended in the claims to cover all modifications which come within the true spirit and scope of the invention.

I claim:

1. A batting aid adapted to be swung at a baseball in batting practice in the manner of a normal, bat, said batting aid comprising: a handle having a longitudinal axis and first and second ends, said handle being configured so that the longitudinal axis of a first portion thereof adjacent to it first end forms a first predetermined angle with a longitudinal axis of the intermediate portion of the handle, said first predetermined angle being displaced approximately three inches from said first end, and so that the longitudinal axis of a second portion of the angle with the longitudinal axis of the intermediate portion of the handle; a frame mounted on the second end of said handle defining the perimeter of an opening for receiving the baseball; flexible means secured to said frame and positioned to net the baseball as it passes through said opening, said handle being adapted to be gripped by the players hands with one hand extending over the first angle between the first portion of the handle and the intermediate portion, and with the other hand on the intermediated portion of the handle, so that both hands are angled with respect to one another, said second angle being substantially equal to said first angle so as to displace said frame into a plane displaced from said first portion of said handle, with the sides of said frame extending substantially parallel to said first portion of said handle.

2. The batting aid defined in claim 1, in which the total length thereof including said handle, frame and grip, is substantially equal to the overall length of a conventional baseball bat.

3. The batting aid defined in claim 1, and which includes a grip mounted on said handle adjacent to said first end and extending over said first angle.

4. The batting aid defined in claim 3, in which said grip has a knob formed on the end thereof.

5. The batting aid defined in claim 1, in which said first angle and said second angle are each of the order of 11°.

* * * * *